US010682579B2

(12) United States Patent
Kelley et al.

(10) Patent No.: US 10,682,579 B2
(45) Date of Patent: Jun. 16, 2020

(54) MANIPULABLE MULTI-PIECE TOY

(71) Applicant: Squaregles LLC, Highland Park, IL (US)

(72) Inventors: Joseph M. Kelley, Highland Park, IL (US); Noah J. Ornstein, Highland Park, IL (US)

(73) Assignee: Squaregles LLC, Highland Park, IL (US)

( * ) Notice: Subject to any disclaimer, the term of this patent is extended or adjusted under 35 U.S.C. 154(b) by 0 days.

(21) Appl. No.: 16/249,220

(22) Filed: Jan. 16, 2019

(65) Prior Publication Data

US 2019/0217212 A1 Jul. 18, 2019

Related U.S. Application Data

(63) Continuation of application No. 15/873,544, filed on Jan. 17, 2018, now Pat. No. 10,220,325.

(51) Int. Cl.

| | |
|---|---|
| ***A63H 3/16*** | (2006.01) |
| ***A63H 3/36*** | (2006.01) |
| ***A63H 33/00*** | (2006.01) |
| ***A63H 3/48*** | (2006.01) |
| ***A63H 17/25*** | (2006.01) |
| ***A63H 17/00*** | (2006.01) |

(52) U.S. Cl.

CPC ..... *A63H 3/16* (2013.01); *A63H 3/365* (2013.01); *A63H 3/48* (2013.01); *A63H 17/002* (2013.01); *A63H 17/25* (2013.01); *A63H 33/003* (2013.01)

(58) Field of Classification Search

CPC ..... A63H 3/16; A63H 3/365; A63H 9/00

See application file for complete search history.

(56) References Cited

U.S. PATENT DOCUMENTS

| | | | |
|---|---|---|---|
| 1,481,227 | A | 1/1924 | Ridderhof |
| 1,990,793 | A | 2/1935 | Matsumoto |

(Continued)

FOREIGN PATENT DOCUMENTS

| | | |
|---|---|---|
| CN | 2708973 | 7/2005 |
| CN | 202355841 | 8/2012 |

(Continued)

OTHER PUBLICATIONS

"Clear Acrylic Baseball Display Case"; available at http://dickstrophies.com/shopping-cart/catalog/display-single-product.php?CSN=32qsPC2y4&PSN=32qsP6B9B&HATC=No&HPP=No at least as early as Jun. 26, 2017.

(Continued)

*Primary Examiner* — John A Ricci

(74) *Attorney, Agent, or Firm* — Fitch, Even, Tabin & Flannery LLP

(57) ABSTRACT

A manipulable multi-piece toy having a spherical body that is removably captured between a base and an attachment member is provided. The base and the attachment member are configured to have portions of a coupling element associated therewith. The base also has a depression with curvature for receiving and securely retaining a first portion of the spherical body in its assembled configuration. In some configurations, the depression comprises a seat with geometry that mates with geometry of the spherical body. By one approach, the base includes a vehicular or figure body. In another aspect, the attachment member includes, for example, a helmet, a hat, a headdress, hair, horns, ears, and/or a mask.

10 Claims, 11 Drawing Sheets

(56) References Cited

U.S. PATENT DOCUMENTS

| | | | |
|---|---|---|---|
| 2,351,762 | A | 6/1944 | Hoover |
| 2,833,083 | A | 5/1958 | Dunstan |
| 3,583,059 | A | 6/1971 | Ceolin |
| 4,019,276 | A | 4/1977 | Nakao |
| 4,645,471 | A | 2/1987 | Herring |
| 4,804,349 | A | 2/1989 | Loscalzo |
| 5,261,848 | A | 11/1993 | Kaplan |
| 5,845,913 | A | 12/1998 | Santarsiero |
| 6,203,393 | B1 | 3/2001 | Flynn |
| 6,595,824 | B2 | 7/2003 | Calello |
| 6,857,930 | B1 | 2/2005 | Lawley, Jr. |
| 6,887,120 | B2 | 5/2005 | Shamitoff |
| 9,573,075 | B1 | 2/2017 | Capriola |
| 2004/0005838 | A1 | 1/2004 | Buckley |
| 2013/0092036 | A1 | 4/2013 | Barrett |

FOREIGN PATENT DOCUMENTS

| | | |
|---|---|---|
| CN | 204193496 | 3/2015 |
| GB | 2521120 | 6/2015 |

OTHER PUBLICATIONS

Extended European Search Report dated Jul. 23, 2019, in corresponding European Patent Application No. 18214852.8.

MANIPULABLE MULTI-PIECE TOY

CROSS-REFERENCE TO RELATED APPLICATIONS

This application is a continuation of U.S. application Ser. No. 15/873,544, filed Jan. 17, 2018, now issued as U.S Pat. No. 10,220,325, which is incorporated herein by reference in its entirety.

FIELD

The present invention relates generally to manipulable multi-piece toys.

BACKGROUND

Toys are loved by children the world over and are one of the pillars of a child's youth and development. Toys can foster cognitive function, develop sports ability, train consciousness, stimulate imagination, arouse curiosity, and provide material conditions for children's physical and mental progress.

Buildable kits, suitable for creating buildings, vehicles, and other structures, can be used by children to create impressive replicas. However, some of these structures have complex design elements, requiring assembly that may be difficult for children who often have limited manual dexterity. Alternatively, some toys that are easier to manipulate may require expensive manufacturing steps including, for example, cumbersome product assembly and/or long production cycles. In addition, some of these toys do not provide an easily changeable, customizable, or adjustable toy.

DETAILED DESCRIPTION

Figure 1:
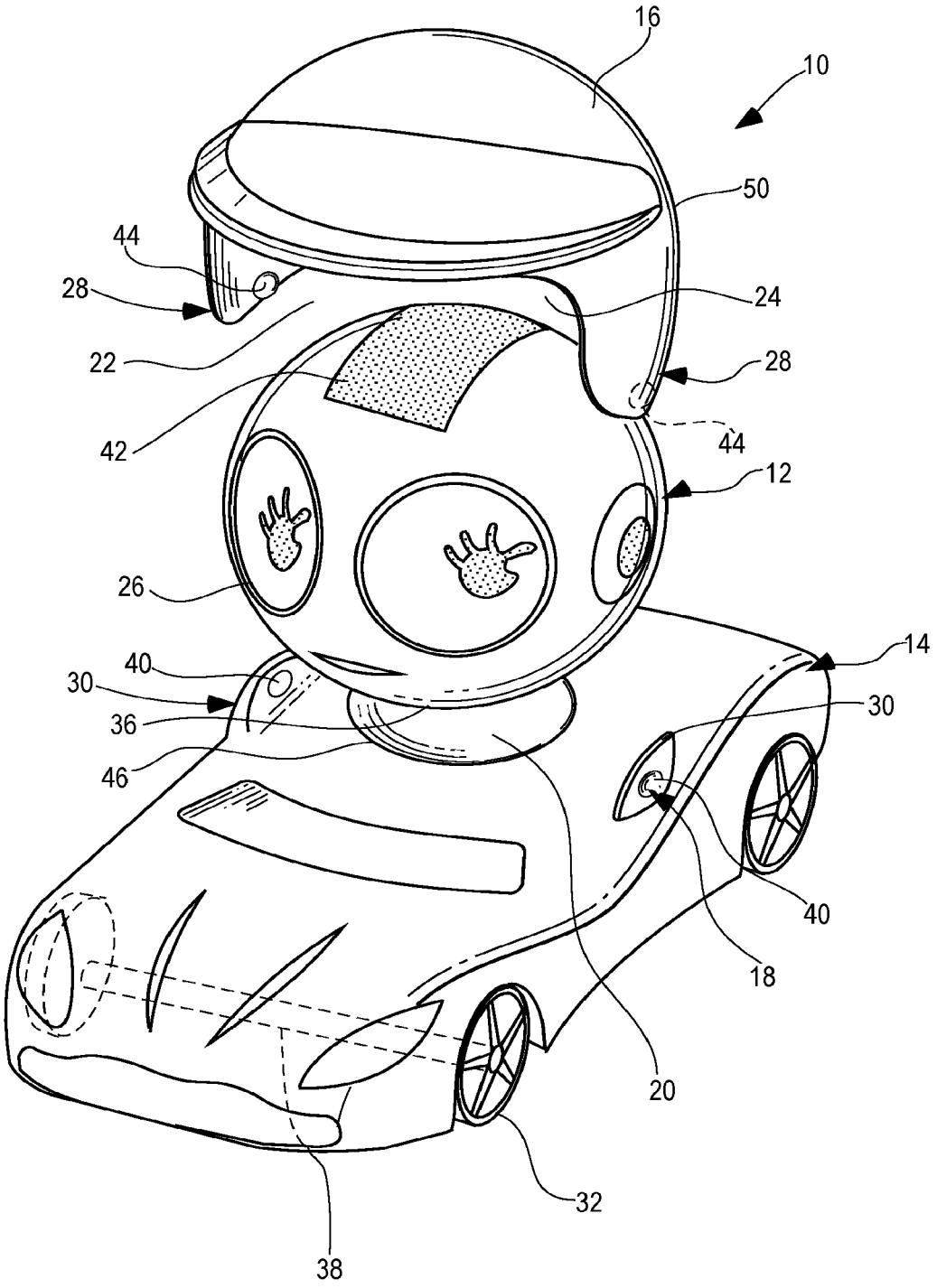
FIG. 1 is an exploded view of a manipulable multi-piece toy in a disassembled configuration.

A manipulable multi-piece toy with interchangeable parts is disclosed herein. In one illustration, the manipulable multi-piece toy includes a three-piece manipulable toy having a spherical body that is removably captured between a base and an attachment member. Being interchangeable, a child may remove one spherical body from a captured position in between the base and attachment piece and exchange it for another spherical body or exchange the attachment member and/or base that captures the spherical body for another attachment member or base, respectively. Further, as described below, the attachment mechanism or coupling elements are designed so that minimal manual dexterity is required to manipulate the multiple pieces of the toy. In this manner, a child can fasten the three pieces together into an assembled configuration, separate the pieces from one another, and reassemble. Further, each of the individual pieces may be of interest to the child and have independent play value. Accordingly, in one illustrative configuration, the spherical body is a resin or rubber ball that a child is able to bounce or roll when separated from the remainder of the multi-piece toy. Also, a portion of the pieces, such as, for example, two or more of the pieces, may be capable of interacting with each other such that a combination of two of the three pieces may have independent play value.

By one approach, the base is configured to have one or more fasteners that directly couple the base and attachment member together, thereby capturing the spherical body therebetween. In one configuration, a first portion of the fastener(s) is disposed on or extending from the base and a second portion of the fastener(s) is disposed on or extending from the attachment piece. The fasteners are manually manipulable to permit the attachment member, the base, and the spherical body to be completely separated from one another.

To help retain the spherical body in position between base and attachment member, the base also has a notch or depression that has a curved shape to receive a first portion of the spherical body in its assembled configuration. In one illustration, the depression comprises a seat with geometry that mates with geometry of the spherical body. Further, the attachment member generally includes a cavity that receives a portion of the spherical body.

By one approach, the manipulable, multi-piece toy includes an opening between a portion of the base and the attachment member exposing a portion of the spherical body that is captured between the base and the attachment member. In one illustrative approach, the attachment piece, which couples to the base, includes a head piece, such as a helmet, a hat, a headdress, hair, horns, ears, and/or a mask. These attachment pieces are configured to mate with the base as described herein and permit a portion of the spherical body to be visible in the attached or assembled configuration. By one approach, the spherical body includes one or more facial features thereon as described below. In one configuration, the facial features are visible through the opening between the base and the attachment member while the spherical body is in an assembled configuration.

As suggested, above, the different pieces of the assembled toy are interchangeable with one another. In this manner, the base, for example, is interchangeable with a second base and the attachment member may be interchangeable with a second attachment member. The manipulable toy can be configured to removably capture the spherical body such that the second base and the second attachment member are interchangeable with the base and the attachment member. In one illustrative example, the base is a vehicular body, which may have wheels attached thereto and the attachment member comprises a helmet that mates with the vehicular body. As used herein, a vehicular body may include any land, water, or air frame including those resembling cars, cycles or bikes, trucks, boats, and planes, etc.

In another example, the base is a figure body. As used herein, the figure body may take a variety of forms such as, for example, humanoid, alien or extraterrestrial, mechanical or robotic, animal, insect, dinosaur, or mythological creatures, among others. By one approach, the base is a figure body that comprises a humanoid body with a pair of arms and legs. Accordingly, the humanoid body mates with the attachment member capturing the spherical body to form a figurine, and the attachment member may include a head piece that mates with the humanoid body.

In yet another embodiment, a manipulable toy includes a base, a head piece, and a face element removably captured between the base and the head piece. In such a configuration, the base has one or more fasteners directly coupling the base and head piece to one another and a seat shaped to receive a first portion of the face element when the toy is in a first assembled configuration. By one approach, the head piece includes a cavity that receives a second portion of the face element in the first assembled configuration. In addition, the manipulable toy may be further configured to have an opening between a portion of the base and the head piece thereby exposing a portion of the face element having one or more facial features thereon.

In another configuration, a manipulable toy for children has multiple bases, multiple head pieces, and multiple face components that are interchangeable with one another. By one approach, one of the interchangeable face components has a front portion with facial features, an upper portion, and a lower portion that engages one of the multiple bases. In an assembled configuration, one of the head pieces engages the upper portion of the face component and the base to removably secure the face component onto the base. Further, when one of the bases, head pieces, and face components are assembled and secured together, at least some of the facial features are visible.

In one illustrative approach, the base component is at least one of: a toy vehicle, a toy human, an extraterrestrial or animal body with arms and/or legs, a toy robot body, and/or a toy building, among others. Furthermore, as suggested above, the toy vehicle may comprise, for example, a car, truck, tractor, motorcycle, locomotive, boat, personal watercraft, snowmobile, aircraft, spacecraft, flying carpet, surfboard, ATV, or construction equipment, among others.

A child can rearrange the components and reassemble the toy by removing the head piece and the face component from engagement with the base, and in turn, secure the head piece and the face component to a different base. For instance, a child can remove the face component and the head piece from a tractor and attach them to a boat or other toy vehicle. Additionally, a child can remove the head piece, such as a helmet, from the face component and attach an alternative head piece, such as hair. The hair, face component, and base can then be secured together. Further still, the face component, such as a humanoid face, can be removed from the head piece and interchanged with another face piece, such as an animal face, and then secured to the head piece and the base.

Referring to FIG. 1, a manipulable three-piece toy 10 in a disassembled configuration is illustrated. As shown, the toy 10 has a spherical body 12, a base 14, and an attachment member 16. The body 12 includes a receiving portion, seat, channel, recess, or depression 20 that is rounded or concave such that a ball or spherical body 12 may partially nest or rest therein. In a first, assembled configuration, the spherical body 12 seats in the depression 20 and is retained there via the attachment member 16. In a second, disassembled configuration, the spherical body 12 and the attachment member 16 are disconnected and separated from the base 14. In one illustrative configuration, the depression 20 is a seat with geometry that mates with the geometry of the spherical body 12 such that the depression 20 cups the spherical body 12. To retain the spherical body 12 in the first, assembled configuration, i.e., in position in the depression 20, the toy 10 includes an attachment member 16 that secures directly to the body or base 14. In one embodiment, shown in FIG. 1, the attachment member 16 is a helmet that attaches or secures to the body 14 via fasteners or coupling elements 18, as described below. By one approach, the spherical body 12, the base 14, and the attachment member 16 are plastic molded materials, such as, for example injection molded with a plastic resin material.

In addition to having a portion of the coupling element 18 associated therewith and a depression 20 for receiving a portion of the spherical body 12, the pedestal or base 14 also has a frame or structure depicting, for example, a vehicle or figure body. FIG. 1 illustrates the base 14 as a vehicular body. The base 14, when configured to be a vehicle, such as a car, may include wheels 32. In one illustrative approach, the base 14 includes wheels 32 and one or more axles 38.

In addition, a variety of other vehicular and figure bodies may be employed. For example, the car base 14 may be interchanged with other vehicles, such as, for example, other car shapes or forms, trucks, tractors, cycles such as motorcycles, locomotives, boats, personal watercraft, snowmobiles, aircraft, spacecraft, flying carpets, surfboards, ATVs, or construction equipment. Figure bodies that form the base 14 may include, for example, a humanoid body, an extraterrestrial body, a mythical creature body, an insect body, or an animal body, such as, for example, with arms and/or legs, or a toy robot body, such as, or example, with arms, legs, casters, and/or wheels, etc. By way of example, the base 14 may have an insect body with eight legs or may be a dinosaur with four legs and a long tail, among many other optional configurations. In yet another configuration, the vehicle could be a motorbike with a sidecar. There are a wide variety of interchangeable options, which may enhance the play value for young children.

As noted above, the cap, lid, or attachment member 16 directly attaches to the base 14 to secure the spherical body 12 in the first, assembled configuration, via coupling elements 18. The coupling elements 18 may take a variety of configurations. In one configuration, the attachment member 16 and the base 14 each have a portion of a single coupling element 18 thereon (see FIGS. 3-6). For example, the coupling elements 18 may include only a single extension and may extend from either the attachment member or the base. In the example of FIG. 3, the attachment member 216 includes a coupling element with a projection 88 that engages with an opening 86 of the base 214 in the assembled configuration. The projection 88 and the opening 86 are sized and shaped to cooperate with one another such that a child can manually grab the attachment member 216 and the base 214 and pull them in separate directions to disengage them from one another. Similar to the base 14 and the attachment member 16 discussed above, these pieces have a shape that allows them to mate together to retain the spherical body 21 in position therebetween. In another configuration, each of the attachment member 16 and the base 14 have multiple coupling elements 18 therein. Further, this may include multiple different coupling elements 18, such as, for example, an embodiment with the fasteners 34 of FIGS. 1 and 2 (as discussed below) and a projection 88 and opening 86 fastener.

Figure 2:
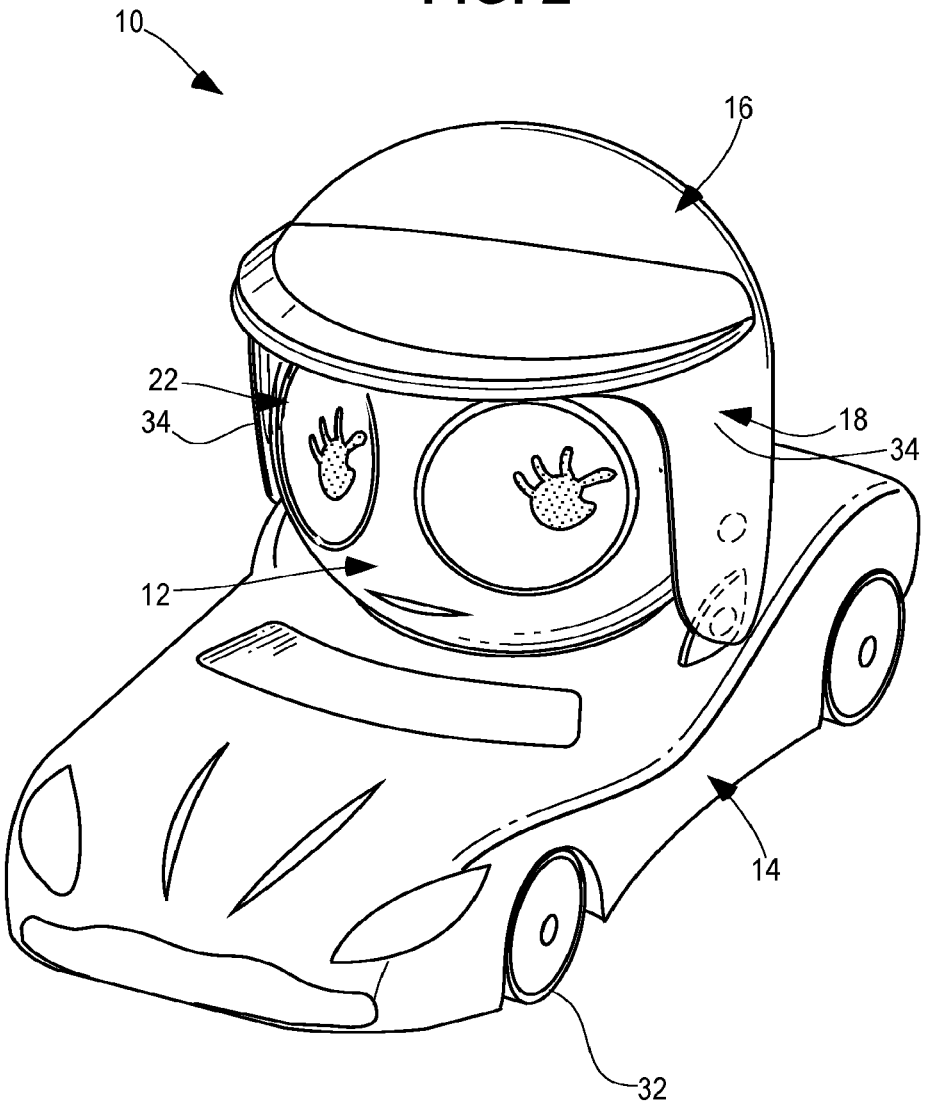
FIG. 2 is a perspective view of the toy of FIG. 1 in an assembled configuration.
Figure 3:
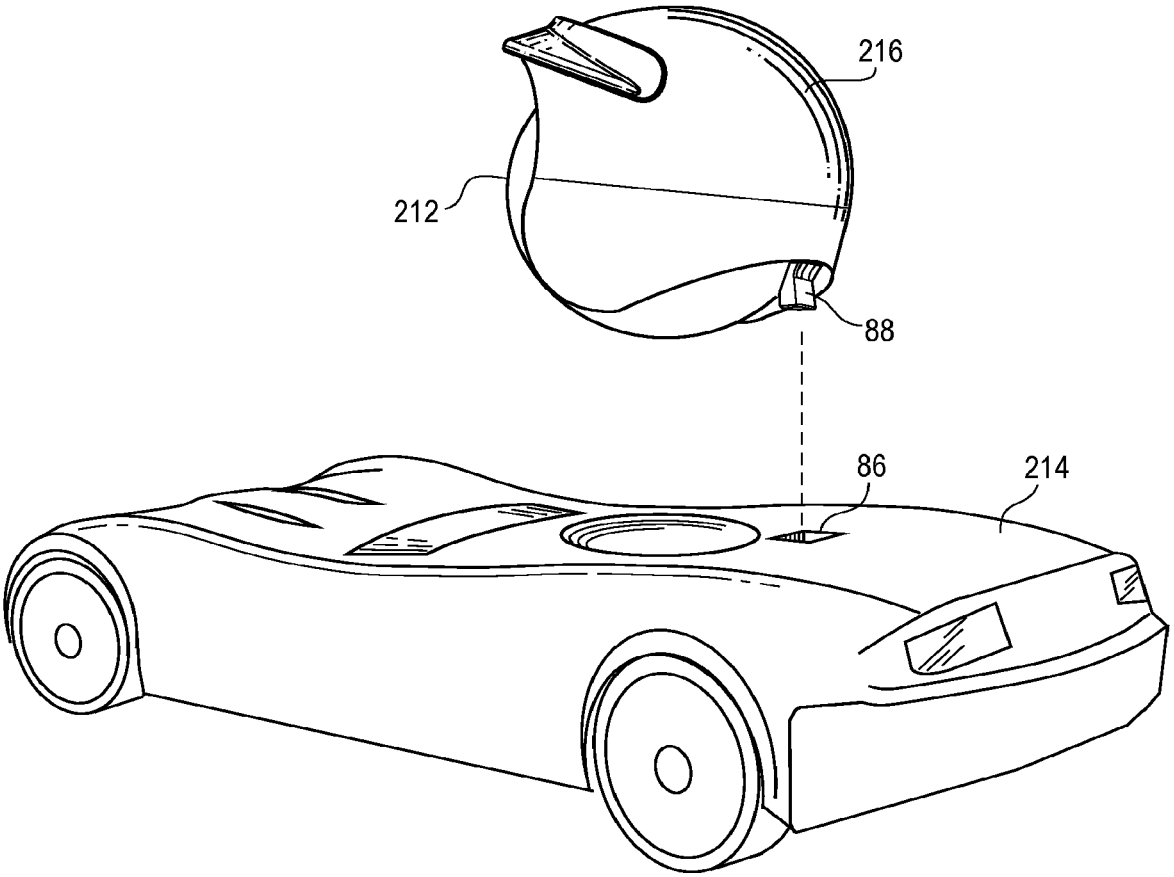
FIG. 3 is a rear perspective of the manipulable multi-piece toy of FIG. 1 illustrating an alternative connection arrangement.

As shown in FIGS. 1 and 2, in one configuration, the coupling element 18 includes a pair of fasteners 34 to secure the attachment member 16 to the base 14 to secure the spherical body 12. More specifically, in this embodiment, the base 14 and the attachment piece 16 have cooperating structure including a pair of tabs, wings, or extensions 28 on the side of the attachment member 16 (depicted as a helmet in this configuration) that engage with projections or tabs 30 of the base, as described further below. The cooperating geometry of the fastener 34 may take a variety of forms. In one illustration, each of the extensions 28 include a notch or bead 44 that extends inward toward one another and engage a depression or opening 40 on the tabs 30 associated with the base 14. By one approach, the extension 28 of the attachment member 16 are configured to flex and bend around the spherical body 12 and the tabs 30 that extend from the base 14 to secure the spherical body 12 into place by having the bead 44 nest with the depression 40 of the tab 30. In addition to the mating geometry of the bead 44 and the depression 40, the tab 30 also may angle or curve outward toward the sides of the base 14 to engage inward curvature of the tabs 28 associated with the attachment member 16.

Figure 4:
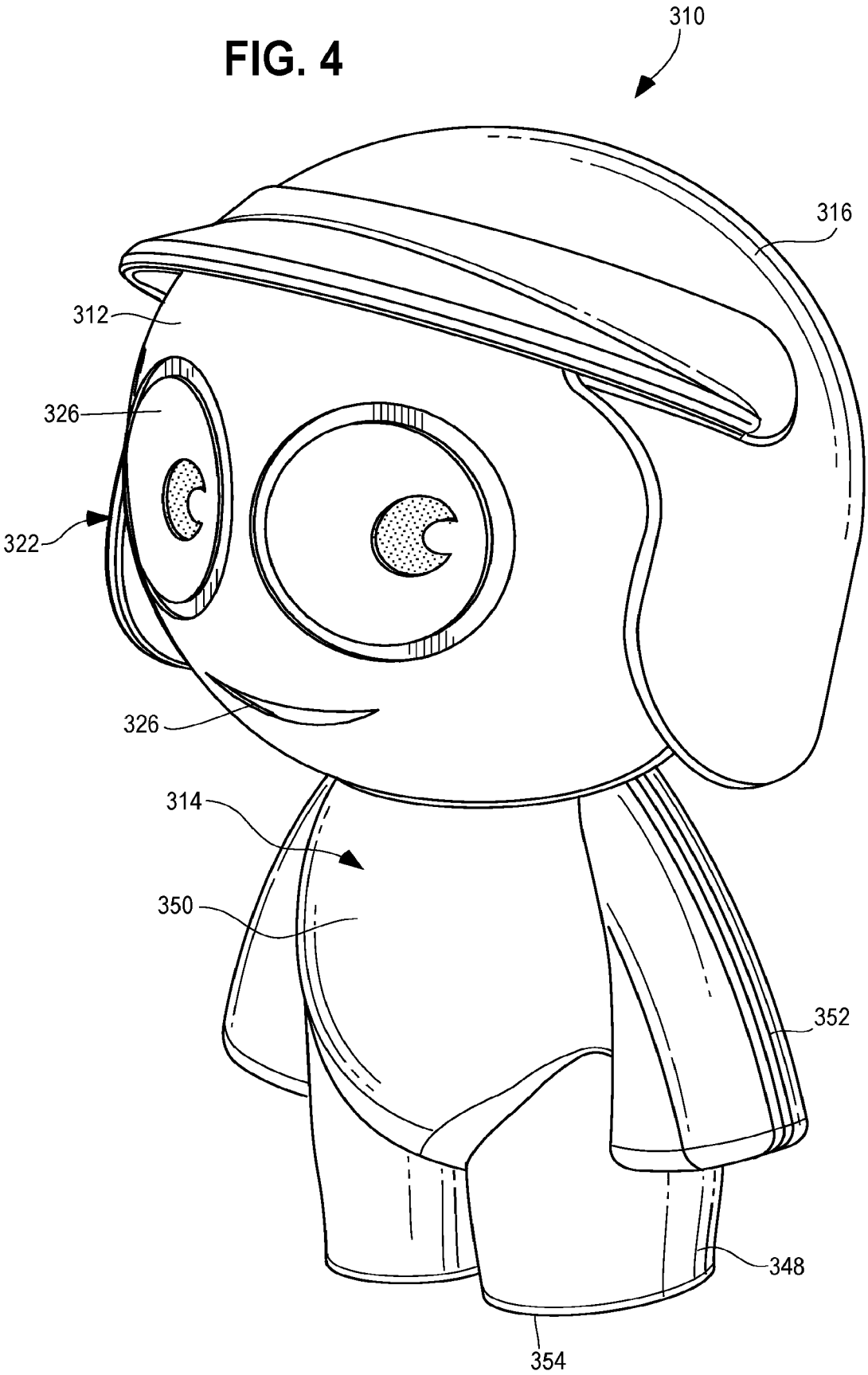
FIG. 4 is a side perspective view of an alternative example of a manipulable multi-piece toy in an assembled configuration.
Figure 5:
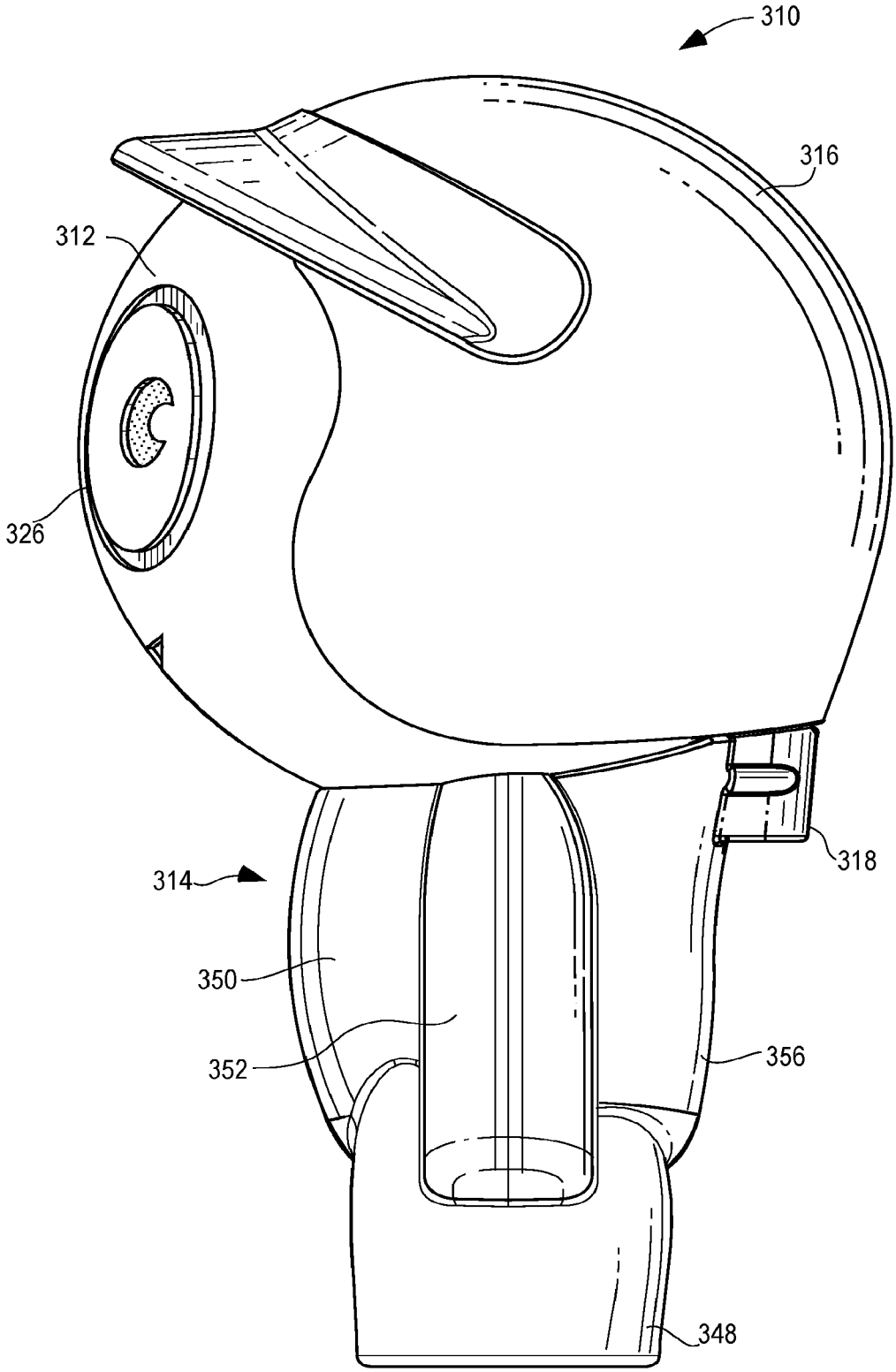
FIG. 5 is a side view of the manipulable multi-piece toy of FIG. 4.
Figure 6:
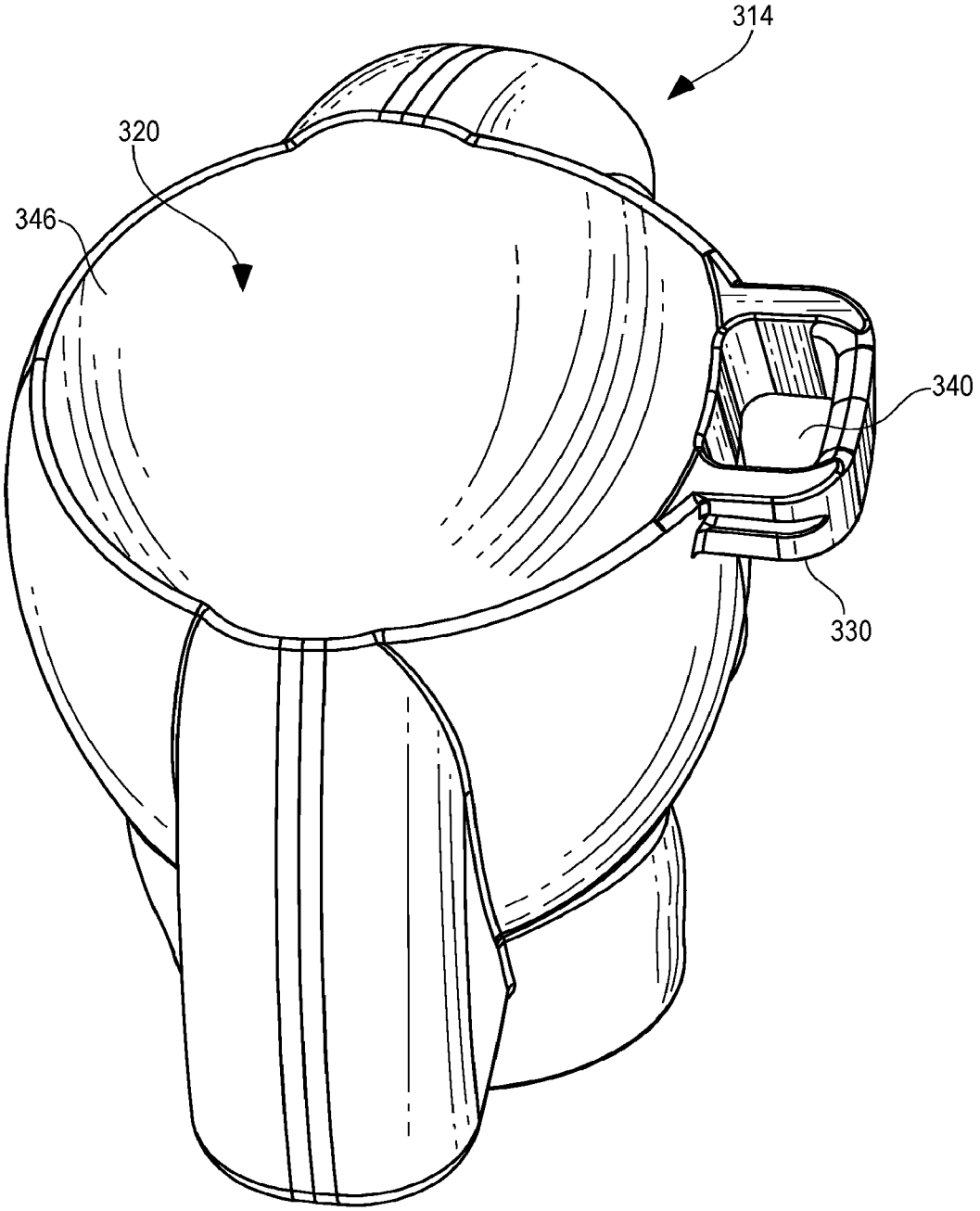
FIG. 6 is a top perspective view of a base of the manipulable multi-piece toy of FIG. 4.

Another coupling arrangement is illustrated in FIGS. 4-6 (discussed further below) and includes a coupling element with one portion associated with an attachment member 316 and another associated with the base 314. The coupling elements 318 may include, for example, a projection, recess, channel, or opening disposed on or extending from the base 314 and a cooperating coupling element 318, such as, for example, an opening, channel, recess, or projection disposed on or extending from the attachment member 316. The coupling member or fasteners can take a variety of configurations. To ensure compatibility and interchangeability of multiple bases 314 and attachment members 316, the same coupling arrangement is typically used for many bases and attachment members. In this manner, if the attachment piece 16 attaches via extensions 28 and tabs 30, as shown in FIG. 1, an interchangeable attachment member 16 having the form of hair, mask, and/or a hat or will have similar structure with extensions and tabs. In yet another configuration, the attachment member 16 and/or the base may have multiple, differently operating coupling members so that the piece may attach to bases and/or attachment members with a variety of different forms.

In addition to having a portion of the coupling member associated therewith, the attachment member 16 also has a housing 50 and a hollow portion, opening, or cavity 24 having a radius of curvature sized to cooperate with the upper portion 42 of the spherical body 12. Though FIGS. 1-6 illustrate the attachment member 16 as a helmet with a visor, a number of different configurations are contemplated. The attachment member 16 may include, for example, a head piece, a helmet, a hat, a headdress, hair, horns, ears, and a mask.

As shown in FIGS. 1 and 2, the spherical body 12 has facial features 26. The facial features 26 may include, for example, eyes, mouth, nose, ears, and/or any other anatomic features of humans, animals, extraterrestrials creatures, etc. For example, the spherical body could be the head of a spider with eight eyes. Furthermore, the facial features may include additional accessories often associated with faces, such as glasses, goggles, a mustache, a sweatband, and a pacifier. As shown in FIG. 2, at least some of the facial features 26 of the spherical body are visible through an opening 22 between the base 14 and the attachment member 16 when the spherical body 12 is the assembled configuration.

In addition to having facial features 26, the spherical body 12 is generally spherical in shape with a diameter of about 0.75-in to about 2.0-in. In another configuration, the spherical body 12 has a diameter in the range of about 1-in. to about 1.5-in. Further, the radius of curvature of the spherical body 12 and the depression 20 are sized to cooperate with one another (e.g., having substantially equivalent radius of curvature), such that a lower portion 36 of the spherical body 12 rests motionless in the depression 20 when the base 14 is not moving. By one approach, the combined attachment member 16 and the spherical body 12 may have a diameter of about 1.0-in to about 1.5-in. In one illustrative embodiment, the attachment member 16 and the spherical body 12 have a diameter of about 1.4-in. The spherical body 12 may be comprised of a variety of plastics, rubber, or composite material. By one approach, the spherical body 12 is in the form of a rubber bouncy ball that will bounce when dislodged from the base 14.

The assembly of the three-piece toy 10 may occur in a number of manners. For example, a child may assemble the toy 10 by seating the spherical body 12 on the depression 20 and pressing or pushing the attachment member 16 towards the base 14 such that an upper portion 42 of the spherical body 12 fits into a cavity 24 of the attachment member 16 and the extensions 28 of the attachment member 16 snap into position around the tabs 30 of the base 14. In this manner, the spherical body 12 is secured within the attachment member 16 and the base 14 as the downward force exerted on the attachment member 16 forces the extensions 28 of the attachment member 16 to bend around the tab 30 and clip into place, thus mating the attachment member 16 to the base 14. In another configuration, the child may pop the spherical body 12 into the cavity 24 of the attachment member 16 and then snap the extensions 28 around the tabs 30 of the base 12. In a similar manner, a child can disassemble the toy. More particularly, a child can disengage the pieces by pulling the attachment member 16 and the base 14 away from one another.

Thus, children may build the toys by snapping pieces together and interchanging elements of the toy. Further, once assembled, children often enjoy playing with the toys. For example, if the base 14 is a car, as illustrated in FIG. 1, the child may drive the car on a track or line up the cars. In addition to playing with the toys in the first, assembled configuration, children may enjoy playing with the toys in an unassembled configuration. For example, children may enjoy driving the base 14 of FIG. 1 with the spherical body 12 associated therewith, but not secured thereto via the attachment member 16. In this manner, if a child drives and crashes the base 14, the spherical body 12 may readily dislodge from the base 14. Depending on the manner of a child's play, the spherical body 12 may lurch forward from its own inertia. To further facilitate this ejection, the depression 20 may be a seat with geometry that facilitates a quick disengagement of the spherical body 12 from the base 14. For example, the seat may have a forward angle such that a lip 46 of the depression 20 is lower toward the front of the base 14 as compared to the height of the lip 46 toward the rear of the base 14.

FIG. 4 illustrates another example of a manipulable multi-piece toy 310 in an assembled configuration. The toy 310 has a base 314 wherein the base 314 is a humanoid figure body. By one approach, the base 314 has a frame 350 with limbs, such as a pair of arms 352 and a pair of legs 348.

By one approach, the legs 348 of the base 314 terminate with generally flat surfaces 354, such that the toy 310 can remain upright and balance when the lower surfaces 354 are in parallel contact with a flat surface. In addition to limbs, other frames may include wings, spider legs, wheels, or other appendages. As noted above, the base 314 is interchangeable with other bases that may be in the form of a vehicle, a toy body dressed in a different manner, an extraterrestrial or animal body with arms and/or legs, a toy robot body, or a toy building or sculpture.

Whether the base 314 has a vehicular or figure body, it has a top portion with a depression 320 conforming to mate to the spherical body 312. The embodiment of FIG. 5 illustrates a depression 320 having a convex surface at the top end of the base 314 and a lip 346 at the upper edge of the depression 320. In yet another configuration, the depression 320 may be formed by having a hollow cavity with the body or base 314, such that the top edge of the body or the lip 346 primarily engages the spherical body 312.

In addition to a base 314, the toy 310 also includes a spherical body 312 and an attachment member 316. The spherical body 312, similar that previously discussed, include facial features 326 disposed thereon. The embodiment of FIG. 4 has facial features 326 that include eyes and a mouth. The facial features 326, or a portion thereof are visible through an opening 322 between the base 314 and the attachment member 316 when the spherical body 312 is in the assembled configuration. Further, the spherical body 312 may be interchanged with a different spherical body. In this manner, a child may switch out a more generic spherical body 312 for one that more closely resembles the child's appearance or has accessories. For example, a child who wears glasses may want to play with a toy 310 that has glasses associated therewith.

While the embodiment of FIGS. 1 and 2 illustrated two coupling elements 18, one on each side of the toy 10, the coupling element 318 of FIG. 5 is illustrated at a rear portion 356 or posterior of the toy 310. As noted above, a number of mating or coupling elements may be employed such that a first coupling element is disposed on the attachment member 316 and a second coupling element is disposed on the base 314. The coupling element may employ a snap fit, friction fit, or another securement mechanism. In one illustrative approach, as shown in FIG. 5, the coupling element 318 may include an extension 330 molded onto a rear of the base 314. By one approach, the extension 330 includes a hole or recess 340 into which a portion of the coupling element 318 from the attachment member 316 (i.e., the extension 328) may extend. The extension 328 also may be molded with the remainder of the attachment member 316. By one approach, the extension 328 is generally rectangular shaped with rounded corners that extends easily into the opening 340 of the extension 330 to provide a friction fit attachment between the attachment member 316 and the base 314 to secure the spherical body 312 therebetween.

The spherical body 312 may be formed in a variety of manners. In one illustrative configuration, the spherical element 312 is manufactured in a unitary configuration and in another configuration, the spherical element 312 is manufactured in multiple portions, such as, for example a first half and second half. If the spherical element 312 is manufactured in pieces, it may be permanently mated together before being provided to children as a toy piece or may be put together, as part of the building set, by a child.

Figure 7:
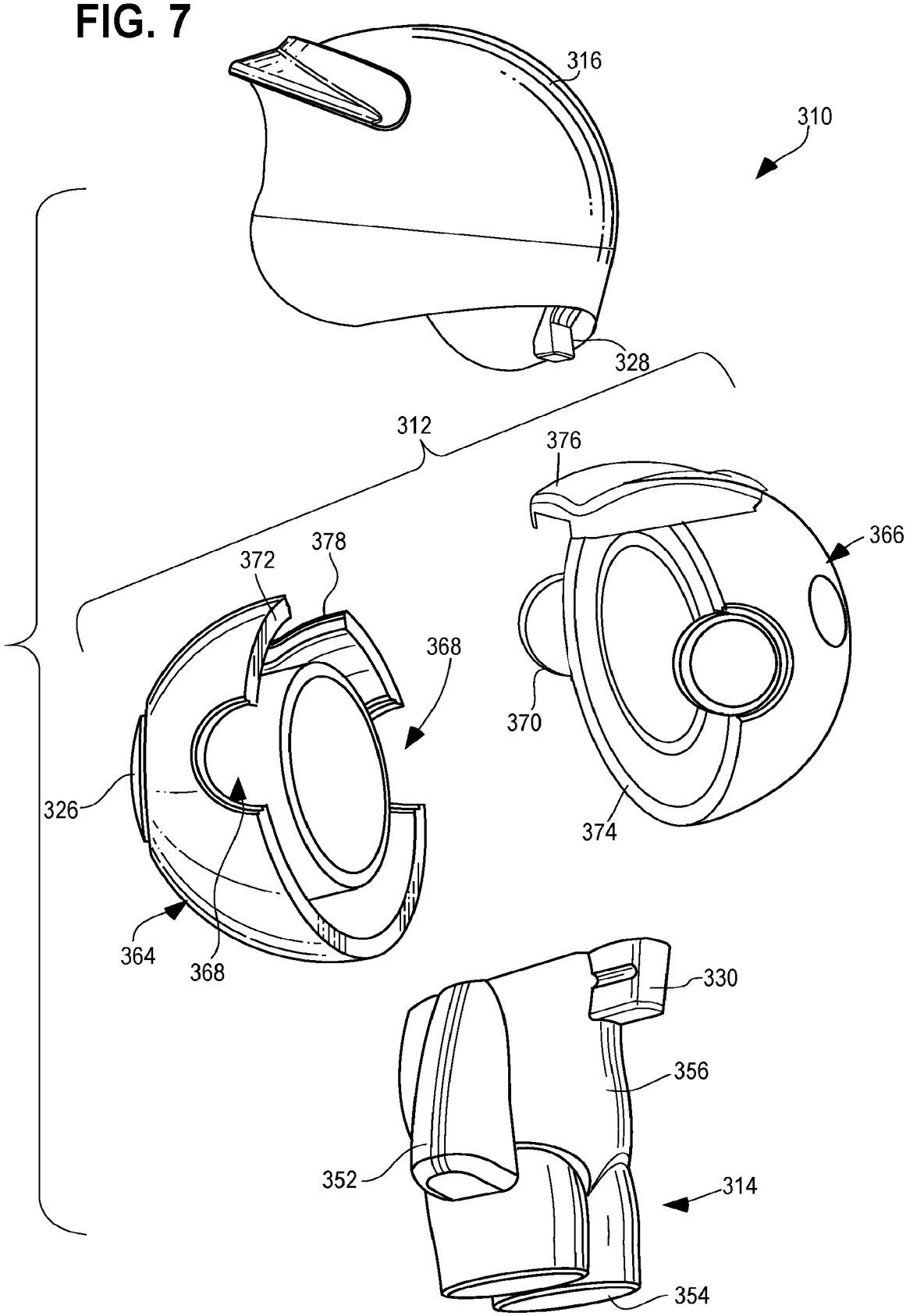
FIG. 7 is an exploded view of the manipulable multi-piece toy of FIG. 4 where the spherical body is disassembled.

In the exploded, disassembled view of FIG. 7, the spherical body 312 of the toy 310 is shown as comprised of a front piece 364 and a rear piece 366. By one approach, these are configurations such that a child can attach and detach from one another by having pieces mate via friction-fit or snap-fit. As shown, the front piece 364 has two semicircle openings 368 disposed on either side of the front piece 364 to which arcuate tabs 370 will extend from the rear piece 366. Further, an annular wall 372 of the front piece 364 sits flush with an annular wall 374 of the rear piece 366. For further secured attachment, a top portion 376 disposed at the top of the rear piece 366 inserts into a curved rectangular opening 378 of the front piece 364 having corresponding geometry.

Figure 8:
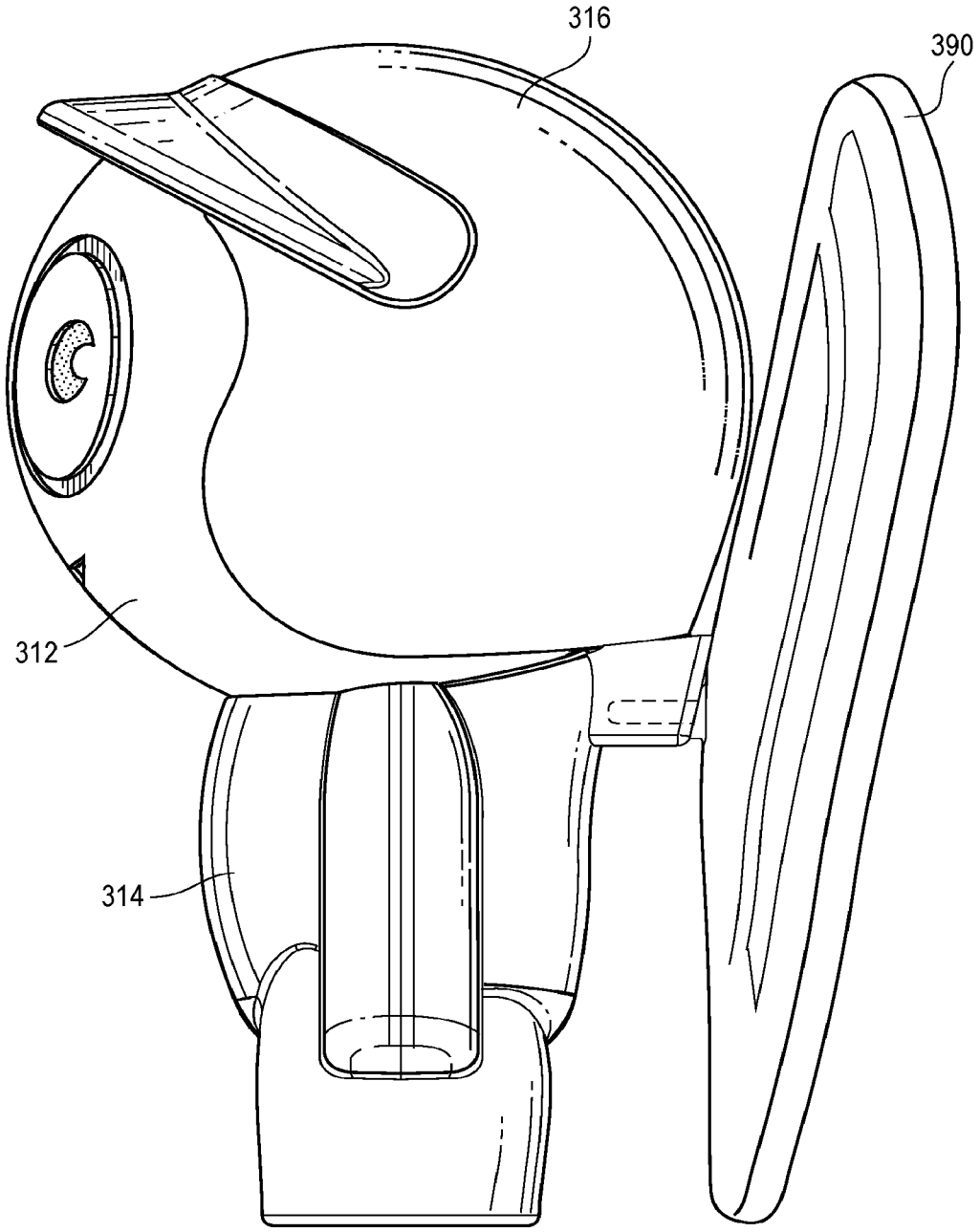
FIG. 8 is a side perspective view of the manipulable multi-piece toy of FIG. 4 having another toy piece attached thereto.
Figure 9:
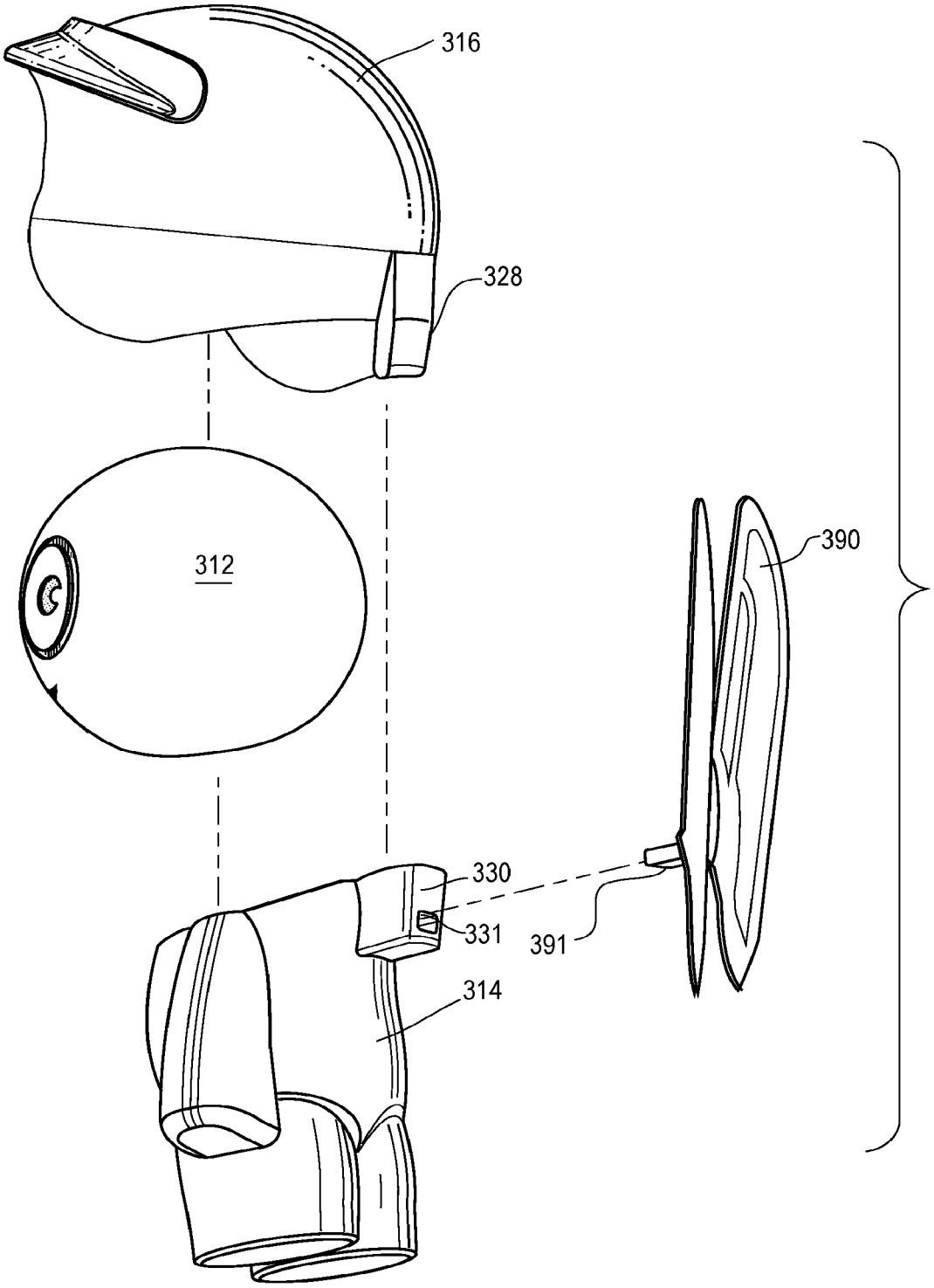
FIG. 9 is an exploded view of the multi-piece toy of FIG. 8.

FIGS. 8 and 9 illustrate another embodiment of the multi-piece toy 310 of FIGS. 4 and 5 with a fourth piece, i.e., a toy accessory 390, attached thereto via an additional slot on the rear of the body 314. The toy accessory 390, illustrated in FIGS. 8 and 9, is a pair of wings, but the toy accessory 390 may be any of a variety of accessories, such as, for example, a backpack, jet pack, shell, cape, and/or shield, among many others. The toy accessory 390, as shown, includes a protuberance or projection 391 that engages a slot 331 that opens to the rear of the body 314 on the extension 330. In yet other configurations, the slot or other coupling mechanism for securing an accessory 390 to a remainder of the multi-piece toy may be disposed anywhere on the base 314, or even the attachment member 316. By one approach, the projection 391 is a relatively flat ledge that extends from the side of the accessory 390 opposite the wings. The projection 391 engages the slot 331 of the body 314 in an assembled configuration. In one embodiment, the projection 391 engages the slot 331 via friction fit to retain the multi-piece toy in the assembled configuration.

Figure 10:
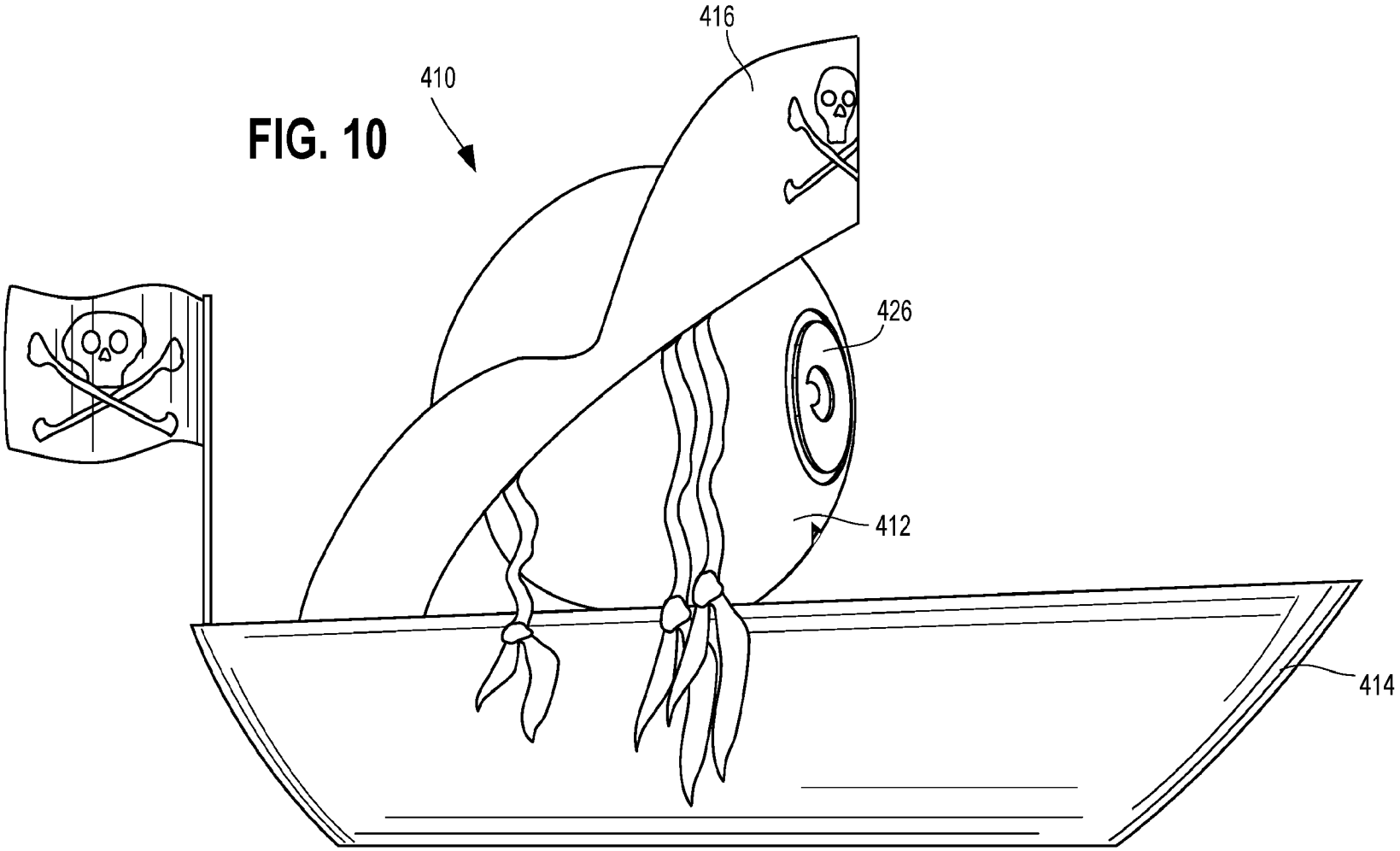
FIG. 10 is an alternative embodiment of a manipulable multi-piece toy.

FIG. 10 illustrates another multi-piece toy 410 having a spherical body 412 captured between a base 414 and an attachment member 416. The spherical body 412 is similar to those previously discussed and has eyes for facial features 426. Further, the toy 410 has a base 414 in the shape of a ship with a pirate flag on the posterior thereof. In addition, the attachment member 416 includes a pirate hat with hair along the side thereof. Though the coupling element 418 is not illustrated here, a number of mechanisms could be employed. For example, a rear edge of the pirate hat of the attachment member 416 may have a portion of the coupling element that engages with corresponding geometry of the ship of the base 414.

Figure 11:
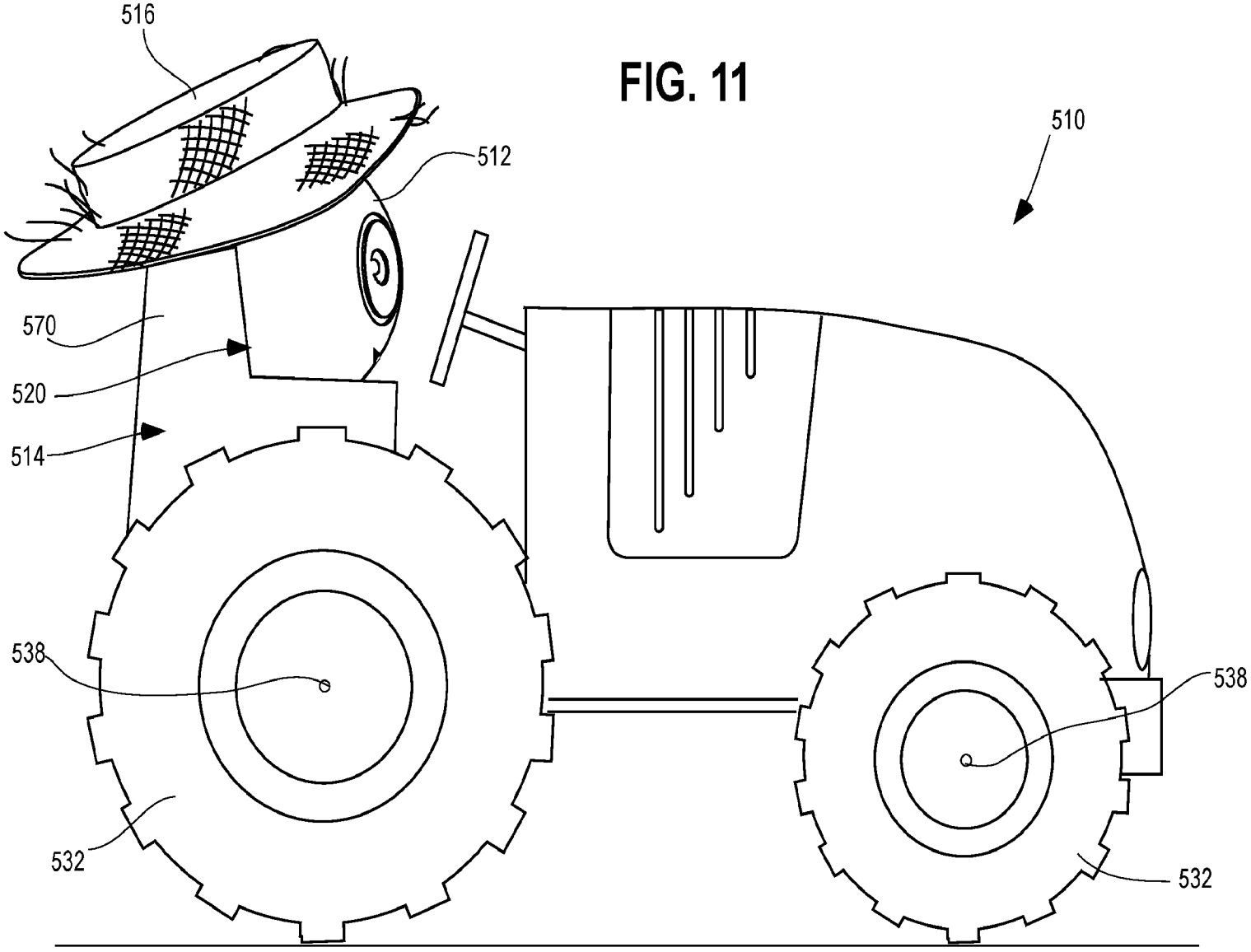
FIG. 11 is a side perspective view of an alternative embodiment of a manipulable multi-piece toy.

In another configuration, shown in FIG. 11, a multi-piece toy 510 includes a spherical body 512 captured between a base 514 and an attachment member 516. The spherical body 512 is similar to those previously discussed. The attachment member 516 also is similar to those previously discussed and includes a straw hat. Further, the base 514 is in the shape of a tractor including wheels 532 associated with axles 538. The base 514 also includes a seat 520 that includes additional geometry as compared to those previously discussed. While previous depressions or seats were merely concave openings in the base, the seat 520 may have a rounded concave opening below the spherical element 512 and behind the spherical element 512. In this manner, the seat 520 may flex outward to receive the spherical element 512 and help retain it into position along with the attachment member 516, which further secures the spherical element 512 by attaching directly with the base 514. Though the coupling element 518 is not illustrated here, a number of mechanisms could be employed. For example, the straw hat of the attachment member 516 may have a portion of the coupling element that engages with corresponding geometry of the tractor chair 570 of the base 514, which also may form, in part, the seat 520 for the spherical body 512.

The matter set forth in the foregoing description and accompanying drawings is offered by way of illustration only and not as a limitation. While embodiments have been shown and described, it will be apparent to those skilled in the art that changes and modifications may be made without departing from the broader aspects of the technological contribution. The actual scope of the protection sought is intended to be defined in the following claims.

What is claimed is:

1. A toy assembly comprising:

a first base comprising one or more friction fit coupling elements;

a first face component comprising a front portion having one or more facial features, an upper portion, and a lower portion, the first face component being supported on the first base with the lower portion of the first face component engaging the first base;

a first head piece engaging the upper portion of the first face component and the one or more friction fit coupling elements of the first base, and removably securing the first face component on the first base;

wherein the facial features are visible while the first face component is removably secured to the first base by the first head piece; and wherein the first head piece and first face component are manually removable and replaceable by children to disassemble and reassemble the toy.

2. The toy assembly of claim 1 further comprising a second face component that is interchangeable with the first face component, the second face component having one or more facial features, an upper portion, and a lower portion.

3. The toy assembly of claim 2 further comprising a second base that is interchangeable with the first base, the second base comprising one or more friction fit coupling elements.

4. The toy assembly of claim 3 further comprising a second head piece that is interchangeable with the first head piece.

5. A method of using the toy assembly of claim 4 comprising removing the first head piece and the first face component from engagement with the first base, and removably securing the first head piece and the first face component to the second base.

6. A method of using the toy assembly of claim 4 comprising removing the first head piece from engagement with the first face component and from engagement with the one or more friction fit coupling elements of the first base, and removably securing the first head piece and the second face component to the second base.

7. A method of using the toy assembly of claim 3 comprising removing the first head piece and the first face component from engagement with the first base, and removably securing the second head piece and the second face component to the first base.

8. The toy assembly of claim 1 further comprising one or more toy accessories, each of the toy accessories including a coupling element that enables each toy accessory to be releasably attached to the first base by insertion of a projection into a slot, with the projection engaging the slot in a friction fit.

9. The toy assembly of claim 1 wherein the base component is a toy vehicle, a toy human, extraterrestrial or animal body with arms and/or legs, a toy robot body, or a toy building.

10. The toy assembly of claim 9 wherein the toy vehicle comprises a car, truck, tractor, motorcycle, locomotive, boat, personal watercraft, snowmobile, aircraft, spacecraft, flying carpet, surfboard, ATV, or construction equipment.

* * * * *